United States Patent [19]

Stern

[11] 4,127,135

[45] Nov. 28, 1978

[54] BRASSIERE

[75] Inventor: Erica Stern, New York, N.Y.

[73] Assignee: Genesco, Inc., Nashville, Tenn.

[21] Appl. No.: 740,713

[22] Filed: Nov. 10, 1976

[51] Int. Cl.[2] ..... A41C 3/00

[52] U.S. Cl. ..... 128/425

[58] Field of Search ..... 128/425, 483, 510, 426

[56] References Cited

U.S. PATENT DOCUMENTS

| | | | |
|---|---|---|---|
| 1,933,983 | 11/1933 | Kennedy | 128/438 |
| 2,755,479 | 7/1956 | LaCascio | 128/425 |
| 3,291,132 | 12/1966 | Puliafico | 128/483 |

FOREIGN PATENT DOCUMENTS

| | | | |
|---|---|---|---|
| 543,745 | 6/1922 | France | 2/425 |

*Primary Examiner*—Doris L. Troutman

*Attorney, Agent, or Firm*—Charles B. Smith; Robert R. Jackson

[57] ABSTRACT

An improved brassiere is provided having two breast receiving cups, the lower adjacent corners of which overlap in securing the bottom edges of the cups to a bottom edge casing of the bra. The adjacent side edges of the cups cross one over the other forming a surplice neckline. Attached to the side edge of one cup at approximately the point where the cup side edges cross and to the bottom edge casing of the bra is a strip of material, which overlaps the side edge and bottom corner of the other cup, whereby the cups are substantially independent of each other.

3 Claims, 5 Drawing Figures

BRASSIERE

BACKGROUND OF THE INVENTION

This invention relates to a brassiere. More particularly, it relates to an improved brassiere having means for readily compensating for body movement, while at the same time maintaining the desired support and appearance of the breasts.

In the past, it has been realized that substantial independence of each cup of a brassiere to accommodate particular body movements is advantageous. However, this advantage has not previously been obtained because it is somewhat outweighed by problems which arise in support of the breasts and appearance when the cups are substantially independent. It has been known to restrict the independence of the cups by overlapping their adjacent lower corners and securing them together where they overlap, but then the independent movement of each cup is also restricted.

To solve this problem, the present invention provides a brassiere having cups which may move independently of each other, while still being somewhat restricted from substantially separating from each other to a degree which creates problems in extra support of the breasts or appearance.

SUMMARY OF THE INVENTION

A brassiere comprising first and second breast receiving cups and a bottom edge casing is provided. The bottom edges of the cups are secured to the bottom edge casing and a strip of material is attached at one end to a side edge of the first cup and at the other end to the bottom edge casing. The side edge of the first cup to which the strip of material is attached is adjacent the second cup and overlaps with a part of the second cup.

Preferably, the overlapped part of the second cup is its lower corner adjacent the first cup and the lower corners of the cups overlap. Most preferably, the strip of material overlaps the lower corner of the second cup and the side edge of the second cup adjacent the side edge of the first cup, while the second cup partially overlaps the first cup.

DETAILED DESCRIPTION OF THE INVENTION

Figure 1:
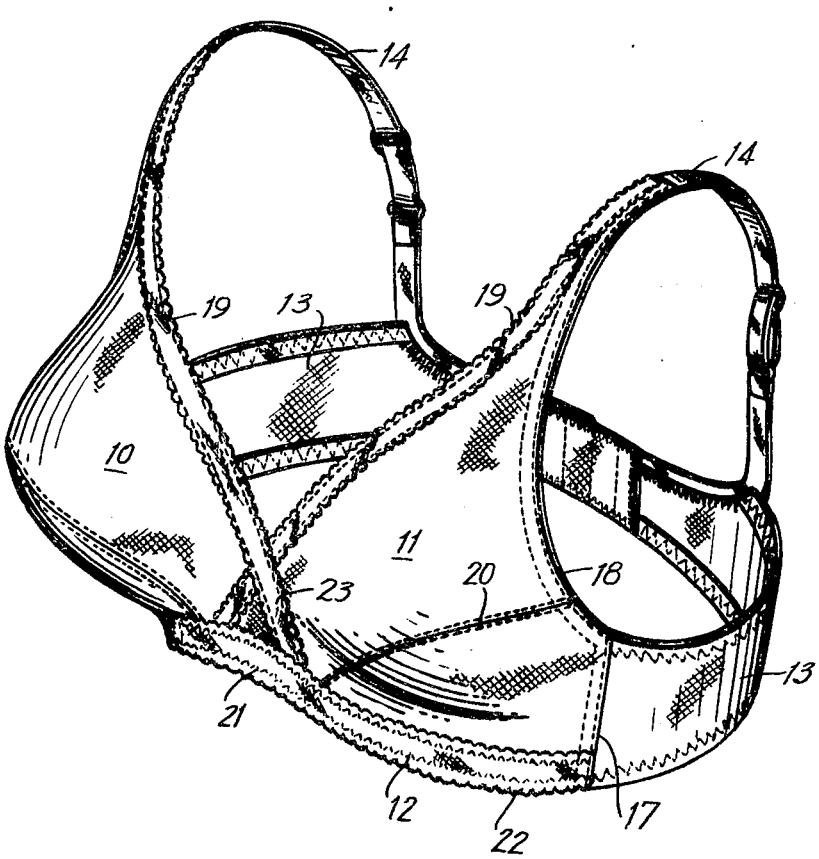
FIG. 1 is a perspective view of an embodiment of the brassiere of the present invention shown in its use condition.
Figure 2:
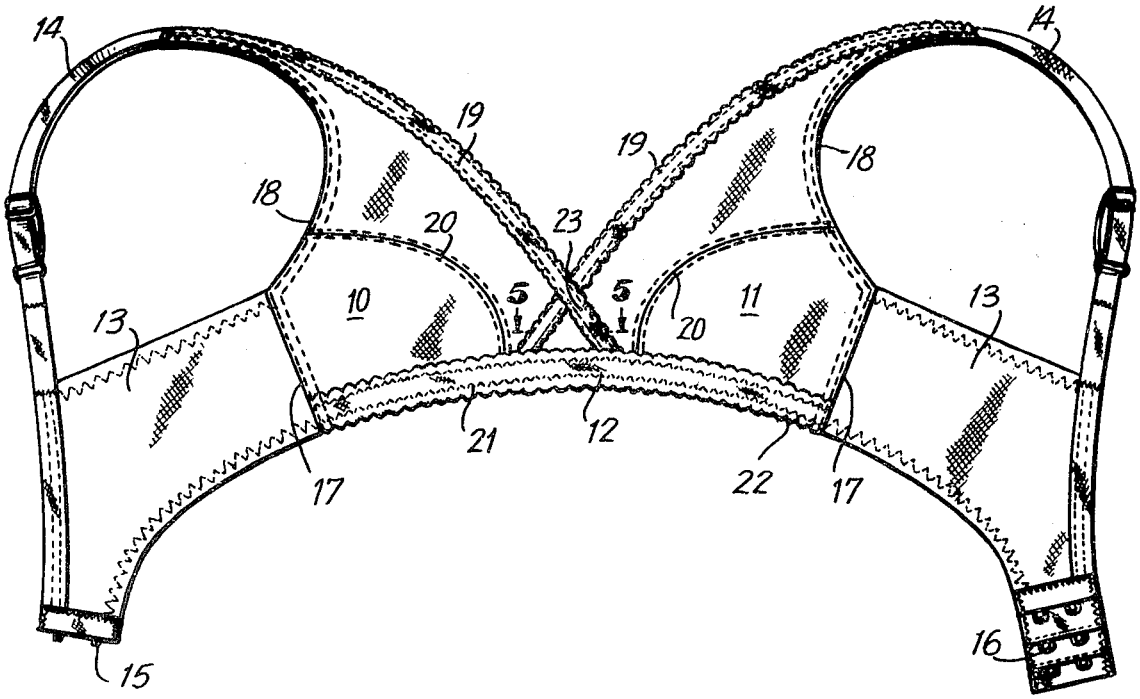
FIG. 2 is a front view of the brassiere of FIG. 1 shown in its non-use condition.

Referring to the drawings, the brassiere of the present invention has breast receiving cups 10 and 11, a bottom edge casing 12, back panels 13, and straps 14. As shown in FIG. 2, back panels 13 are each attached and cooperate with one of the straps 14 to provide a means for applying the brassiere to the body of the user. At the extremity of one of the panels 13 are hooks 15 and at the extremity of the other panel 13 are eyelets 16, which capture hooks 15 when the brassiere is in the use condition shown in FIG. 1. Each strap 14 attaches to or is intergral with a panel 13 at one of its ends and at the other of its ends to the breast supporting portions of the brassiere.

The breast supporting portions of the brassiere are essentially the cups 10 and 11, which each have a bottom edge and two side edges. Relative to the front center of the brassiere, the outermost side edge of each cup is generally formed of two portions. The lowermost portion is generally referred to as a side seam, which is illustrated in the drawings at 17. The uppermost portion is generally referred to as an underarm seam, which is illustrated in the drawings at 18. Side seam 17 of each cup attaches to or is integral with a back panel 13. In the particular embodiment of the brassiere of this invention shown in FIGS. 1–5, each strap 14, which is generally known as a "built-up" strap, attaches to or is integral with one of the cups at the juncture of the top of underarm seam 18 and of the innermost side edge of the cup, which is indicated in the drawings at 19. As illustrated in the drawings, this particular embodiment of the brassiere of the present invention also includes an overbust seam 20 in each cup 10 and 11.

As mentioned above, each cup 10 and 11 has the above described side edges and a bottom edge (not shown). Generally, although one could make this brassiere without encasing or otherwise "finishing" its edges, it is preferable that side edges 19 be encased within or have attached thereto one or more layers of material or stripping. Also, as shown in FIG. 2, a stripping is stitched across the bottom edges of cups 10 and 11 to form bottom edge casing 12, as indicated at 21. A frill or decorative effect may be made in the stripping covering side edges 19 or the bottom edges of the cups, as indicated at 22. It is to be understood that the determination of the particular arrangement or number of layers of stripping in casing 12 or attached to side edges 19 is within the scope of one versed in the art. Most importantly, the bottom edges of the cups are prevented from substantially separating from each other.

Referring particularly to FIG. 2, each side edge 19 is covered with a layer of stripping stitched thereto as described above. One end of each side edge 19 is integral with or attached to a strap 14. The other end of each side edge 19 is secured to bottom edge casing 12. However, to allow cups 10 and 11 to move independently, the stripping covering side edge 19 of one of the cups is separated from the edge and overlaps the side edge 19 of the other of the cups prior to being secured to bottom edge casing 12. Thus, the bottom edges of the cups are secured to bottom edge casing 12, but the innermost side edges 19 of the cups are independent of each other to some degree, so that each cup may accommodate body movement.

Figure 3:
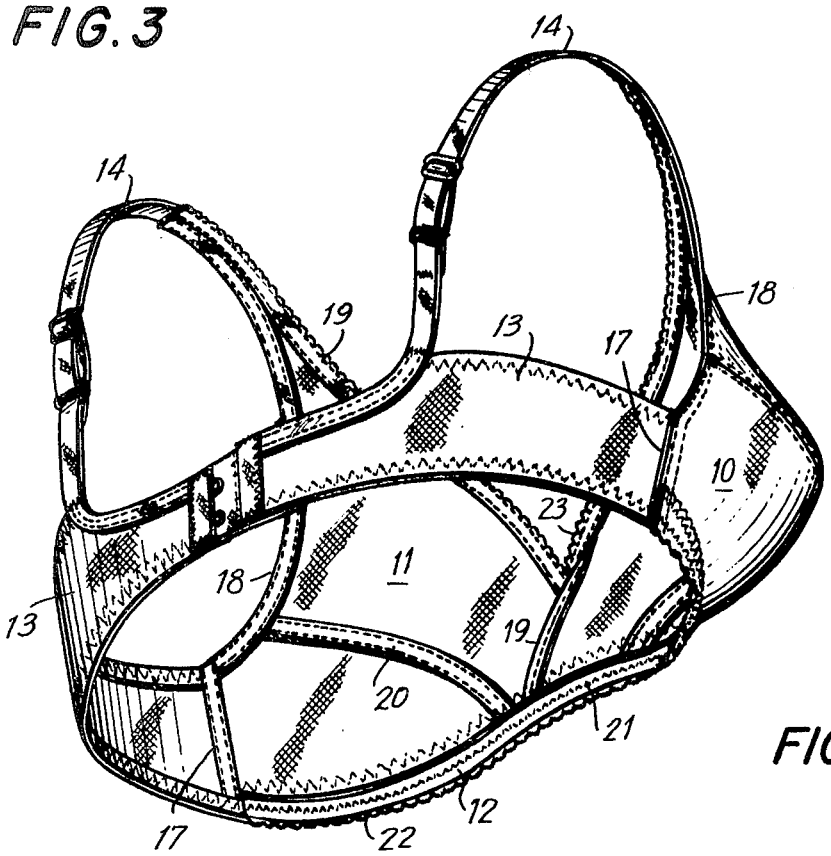
FIG. 3 is a rear, perspective view of the brassiere of FIG. 1 shown in its use condition.
Figure 5:
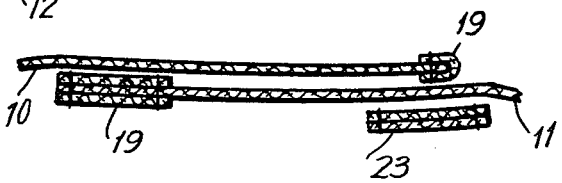
FIG. 5 is a cross sectional view along lines 5—5 of a portion of the brassiere shown in FIG. 2.
Figure 4:
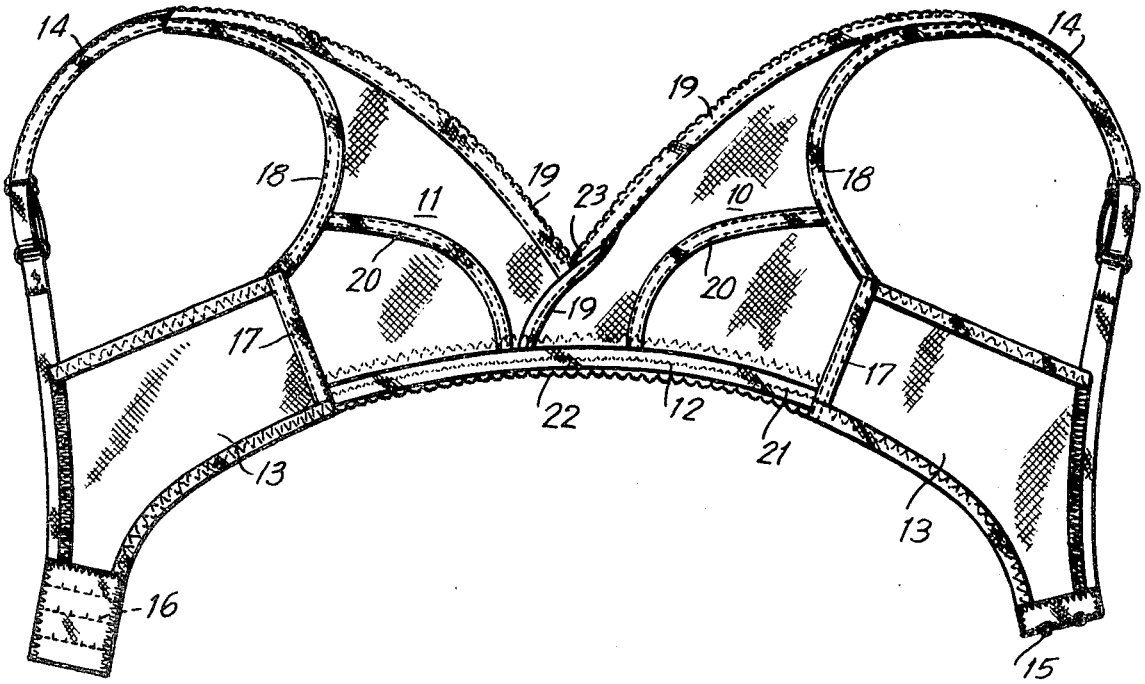
FIG. 4 is a rear view of the brassiere of FIG. 3 shown in its non-use condition.

Referring now to FIGS. 3–5, this overlapping arrangement of side edges 19 and the separated strip of material, which is indicated in the drawings at 23, is more easily seen. At the point where side edge 19 of cup 10 crosses side edge 19 of cup 11 to form a surplice neckline in the brassiere, the stripping stitched to side edge 19 of cup 10 and the edge itself are separated. Edge 19 of cup 10 and the bottom edge of cup 10 are secured to bottom edge casing 12. Side edge 19 of cup 11 extends downwardly, is overlapped by the lower corner and side edge 19 of cup 10, and is also secured to bottom edge casing 12. Finally, the stripping covering side edge 19 in cup 10 that has been separated therefrom extends downwardly, is overlapped by the lower corner and side edge 19 of cup 11, and is also secured to bottom edge casing 12. As shown in FIG. 5 particularly, side edge 19 of cup 10 and the strip of material 23 surround the lower corner and side edge 19 of cup 11.

Although the brassiere of the present invention illustrated in FIGS. 1–5 has overlapping cups 10 and 11, it is contemplated that the cups each have a strip of material 23, which strips overlap each other, whereby the lower corners of cups 10 and 11 need not overlap. In this event, the cups would be somewhat separated but not free to separate from each other to a degree which would affect the support provided by the brassiere or its appearance. In addition, bottom edge casing 12 could be made of two or more independent bands held together, rather than the single strip of material shown in the drawings. In addition, it has been found that the construction of the brassiere of the present invention is compatible with cups formed of more than one layer of material. Preferably, cups 10 and 11 will be multi-laminar, where each lamina is most preferably formed of a different type of material. For instance, the inside lamina contacting the body of the user could be cotton material whereas the outside lamina could be a different material, such as a material sold under the trademark "Crepeset", which is available from the America Enka Company, Enka, N.C.

Modifications of the brassiere of the present invention described above will occur to those skilled in the art and are contemplated to be within the scope of this invention.

What is claimed is:

1. A brassiere comprising first and second breast receiving cups and a bottom edge casing, the inner lower corner of the second cup adjacent the first cup overlying the inner lower corner of the first cup adjacent the second cup without attachment between the cups, the bottom edges of the cups being secured to the bottom edge casing, a strip of material attached to an inner side edge of the first cup above the overlying inner corner of the second cup, the strip extending down over the overlying corner of the second cup without attachment to either the first or second cup and having its lower end attached to the bottom edge casing.

2. The brassiere of claim 1 wherein the strip of material overlies the second cup parallel to the inner edge of the first cup adjacent the second cup.

3. The brassiere of claim 1 further comprising a second strip of material attached to the inner edge of the second cup adjacent the first cup, the second strip crossing under the strip attached to the first cup and having its lower end attached to the bottom edge casing.

* * * * *